United States Patent [19]

Ulrich

[11] Patent Number: 4,743,165

[45] Date of Patent: May 10, 1988

[54] DRUM ROTORS FOR GAS TURBINE ENGINES

[75] Inventor: William R. Ulrich, Lake Park, Fla.

[73] Assignee: United Technologies Corporation, Hartford, Conn.

[21] Appl. No.: 921,729

[22] Filed: Oct. 22, 1986

[51] Int. Cl.[4] ..... F01D 5/06

[52] U.S. Cl. ..... 416/198 A; 29/156.8 R; 29/DIG. 48; 219/118

[58] Field of Search ..... 416/198 A; 29/156.8 R, 29/DIG. 48; 219/118, 121 EC, 121 LC

[56] References Cited

U.S. PATENT DOCUMENTS

| | | | |
|---|---|---|---|
| 2,555,256 | 5/1951 | Tyson | 138/47 |
| 3,067,490 | 12/1962 | Luthy et al. | 416/198 A |
| 3,559,227 | 2/1971 | Marianeschi | 416/198 A |
| 3,560,700 | 2/1971 | Reidelsture et al. | 219/121 |
| 3,780,412 | 12/1973 | Millard | 29/157.1 |
| 3,876,335 | 4/1975 | Forcinal et al. | 416/198 A |
| 3,894,324 | 7/1975 | Holzapfel et al. | 29/156.8 |
| 3,967,919 | 7/1976 | Coulon et al. | 416/198 A |
| 3,975,612 | 8/1976 | Nakazaki et al. | 219/121 |
| 4,033,501 | 7/1977 | Ambrose, Jr. et al. | 228/2 |
| 4,159,410 | 6/1979 | Cooper | 219/137.7 |
| 4,178,022 | 12/1979 | Hanneman | 285/286 |
| 4,209,123 | 6/1980 | Jay | 228/175 |
| 4,333,671 | 6/1982 | Holko | 285/173 |
| 4,426,191 | 1/1984 | Brodell et al. | 415/189 |
| 4,483,054 | 11/1984 | Ledwith | 29/156.8 |
| 4,581,300 | 4/1986 | Hoppin, III et al. | 428/546 |
| 4,587,700 | 5/1986 | Curbishley et al. | 29/156.8 |

*Primary Examiner*—Robert E. Garrett
*Assistant Examiner*—John T. Kwon
*Attorney, Agent, or Firm*—James M. Rashid

[57] ABSTRACT

A one piece, welded drum rotor for a gas turbine engine is described. The drum rotor is characterized by disks having a superalloy composition which is different from the seal alloy composition. Several welding techniques are utilized to join the drum rotor components to each other.

12 Claims, 3 Drawing Sheets

DRUM ROTORS FOR GAS TURBINE ENGINES

TECHNICAL FIELD

This invention relates to rotors for turbomachines; in particular, it relates to drum rotors for gas turbine engines.

BACKGROUND

Drum rotors are well known in the gas turbine engine industry. See, e.g., commonly assigned U.S. Pat. Nos. 4,426,191 to Brodell et al and 4,483,054 to Ledwith. Most drum rotors have a spacer or knife edge labyrinth seal between adjacent rotor stages (disks).

The components of the prior art drum rotors (i.e., the disks and seals) are fabricated from the same alloy; drum rotors used in some gas turbine engines are made of high strength superalloys, such as IN100. Nonetheless, they may become damaged or worn during service use. The knife edge seals are typically thin wall structures, and are relatively fragile; as a result, they are especially prone to damage and wear. Once damaged or worn, these seals must be repaired if further use of the drum rotor is desired. However, superalloys like IN100 have a tendency to crack when repaired using known weld repair techniques, such as those shown in U.S. Pat. No. 4,159,410 to Cooper. This factor significantly complicates the repair of the knife edges. The inability to readily weld repair the knife edges, therefore, complicates the use of drum rotors made from such high strength superalloys. Accordingly, engineers have sought to define improved materials and fabrication techniques which will produce drum rotors made of high strength superalloy materials and are weld repairable.

SUMMARY OF INVENTION

According to the invention, a drum rotor for a turbomachine such as a gas turbine engine comprises first and second disks, and a seal therebetween, the disks having a superalloy composition which is different from the seal alloy composition. The invention also relates to a method for welding together the components of the drum rotor, which have different compositions. These compositions are selected to provide the disks and the seal with particularly desired properties.

One of the important features of this invention is the manner in which the seal is made, and the manner in which the seal is joined to its adjacent disks. According to this invention, the seal is made by welding together at least a pair of annular rings, or subdetails, which are eventually machined into the desired seal configuration. In other words, the seal comprises a first annular seal subdetail and a second annular seal subdetail. Prior to welding the seal subdetails to each other, however, the first disk is inertia (friction) welded to the first seal subdetail to form a first annular subassembly, and the second disk is inertia welded to the second seal subdetail to form a second annular subassembly. Then, the subassemblies are coupled to each other so that the seal subdetails abut each other, and the subassemblies are high energy beam welded to each other to form a drum rotor. Finally, the welded drum rotor is machined, including the machining of knife edges on the seal.

Construction of the drum rotor as described above permits the disks to be made of a high strength superalloy like IN100, which has desirably low crack growth rates. The seals can be made of an alloy like Inconel Alloy 718, which can be readily weld repaired. The particular fabrication technique of the invention drum rotor also permits axially extending blade retaining slots to be machined into the disk rims prior to welding. The use of axially extending slots makes the drum rotor lighter in weight as compared to prior art drum rotors, which are limited to having circumferentially extending blade retaining slots.

If the seal portion of the invention drum rotor is damaged or worn, it may readily be repaired by removing an annular (360°) portion of the seal which contains the damaged area, and replacing it with an undamaged seal of like dimension. The damaged portion is removed so that a 360° piece of each original seal subdetail remains welded to each disk. In other words, the removed, damaged portion is between the inertia weld which joins each disk to its respective seal subdetail. Then, the undamaged seal is inserted in place of the damaged seal, and is high energy beam welded to the remaining portion of the seal subdetails. Following any necessary machining, the repaired drum rotor is again ready for service.

BEST MODE FOR CARRYING OUT THE INVENTION

Figure 1:
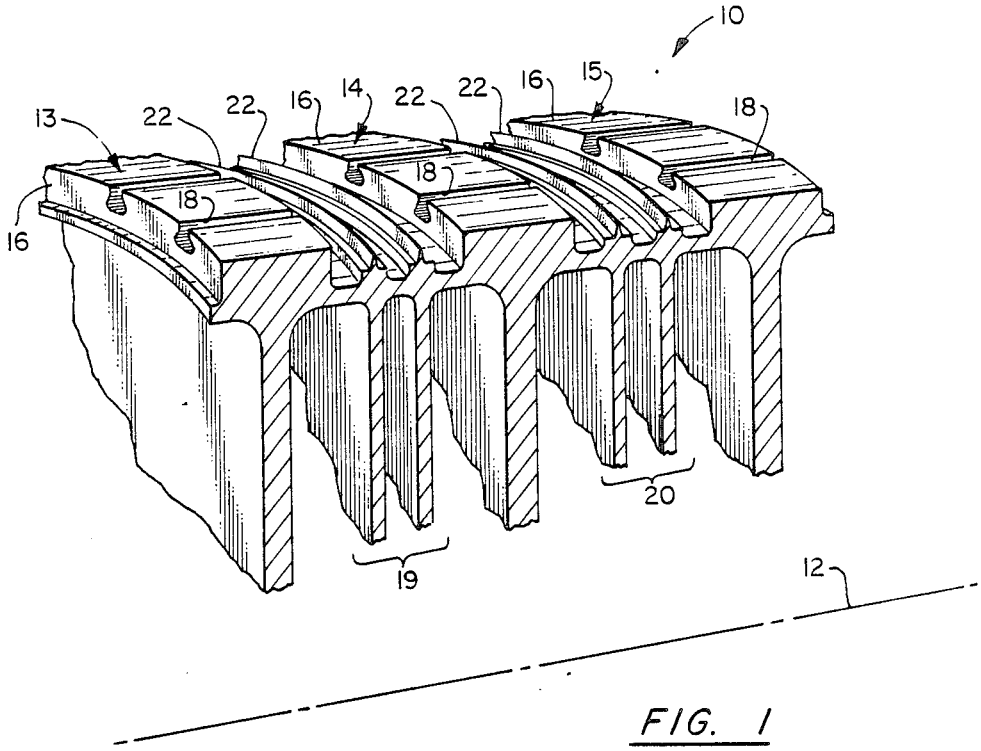
FIG. 1 is a perspective view, partly in cross section, showing a drum rotor useful in a gas turbine engine.

FIG. 1 shows a portion of a drum rotor made according to the present invention. The drum rotor is represented by the reference numeral 10, has an axis of rotation 12, and is shown as having three rotor stages or disks 13, 14, 15. The number of rotor stages is not a critical aspect of the invention. Machined into the rim 16 of each disk are blade retaining slots 18. Due to the method in which the invention drum rotor 10 is made, the slots 18 may be circumferentially extending or axially extending. In the preferred embodiment of this invention, and as shown in FIG. 1, the blade retaining slots 18 extend in the axial direction. Between and integral with each pair of adjacent disks is a labyrinth seal or spacer. As is seen in the Figures, the seal 19 is between the disks 13, 14, and the seal 20 is between the disks 14, 15. Projecting radially outwardly on each seal 19, 20 is at least one knife edge 22. During engine operation, the knife edge 22 sealingly engages an abradable seal (not shown) which is attached to the inner wall of the engine case. Such engagement limits leakage of working medium gases in the axial direction.

As noted in the Background section, the seal and especially the relatively fragile knife edges 22 are sometimes damaged or worn during service operation, and then must be replaced or repaired. However, some superalloys used to make drum rotors 10 are chosen primarily for their high strength, and are not readily repaired using conventional welding techniques. The alloy known as IN100 is one such superalloy.

In the drum rotor 10 of the invention, the disks 13, 14, 15 are made of a high strength superalloy, while the seals 19, 20 are made of an alloy having a composition different from the superalloy composition. The seal alloy is weld repairable, and in addition, is readily welded to the disk superalloy using conventional techniques. The preferred disk superalloy is IN100, whose composition, by weight percent, is 8–11 Cr, 13–17 Co, 2–4 Mo, 4.5–5 Ti, 5–6 Al, 0.7–1.2 V, 1 Fe, 0.01–0.02 B, 0.03–0.09 Zr, 0.15–0.2 C, balance Ni; the preferred seal alloy is Inconel Alloy 718 (IN718), whose composition, by weight percent, is 50–55 Ni, 17–21 Cr, 4.75–5.5 Cb+Ta, 2.8–3.3 Mo, 0.65–1.15 Ti, 0.2–0.8 Al, 0.35 Si, 0.3 Cu, 0.006 B, 0.08 C, 0.35 Mn, balance Fe. IN100 is preferred as the disk alloy because of its high strength capability and excellent resistance to crack growth. IN718 is the preferred seal alloy because of its desirable machinability and relatively low cost. Also, as mentioned above, it is weldable.

Figure 2:
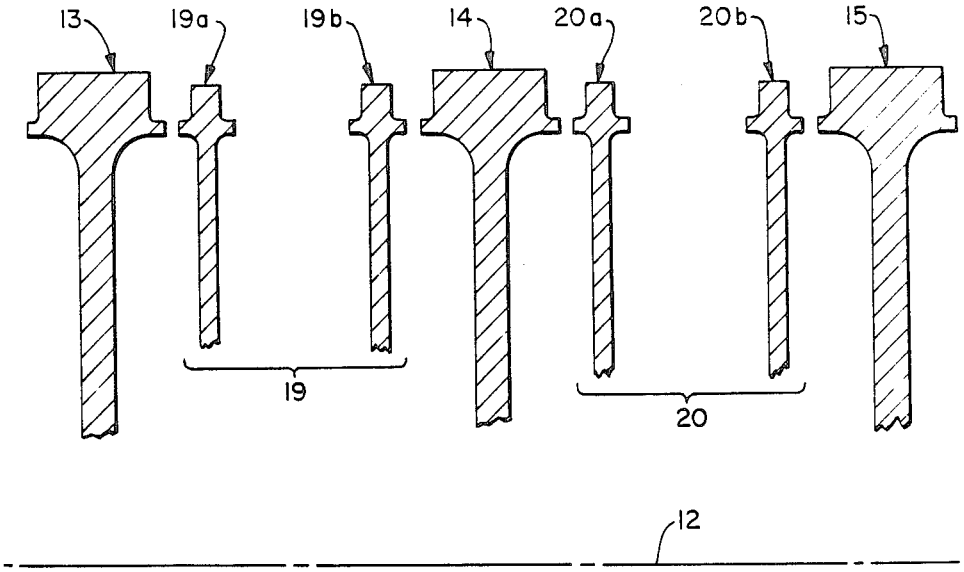
FIGS. 2–4 are simplified sectional views showing a method for making the drum rotor according to the invention.
Figure 3:
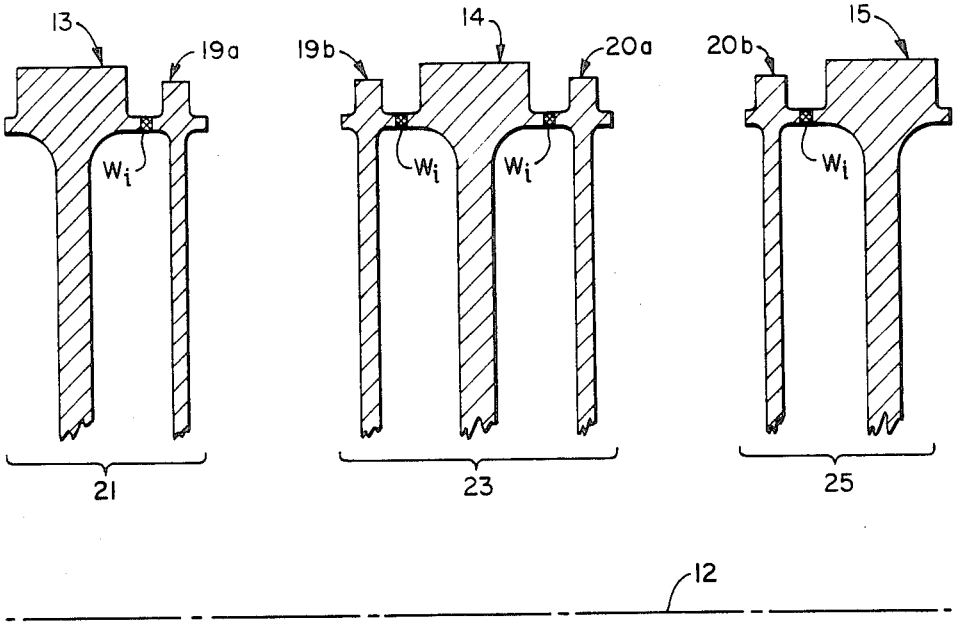
Figure 4:
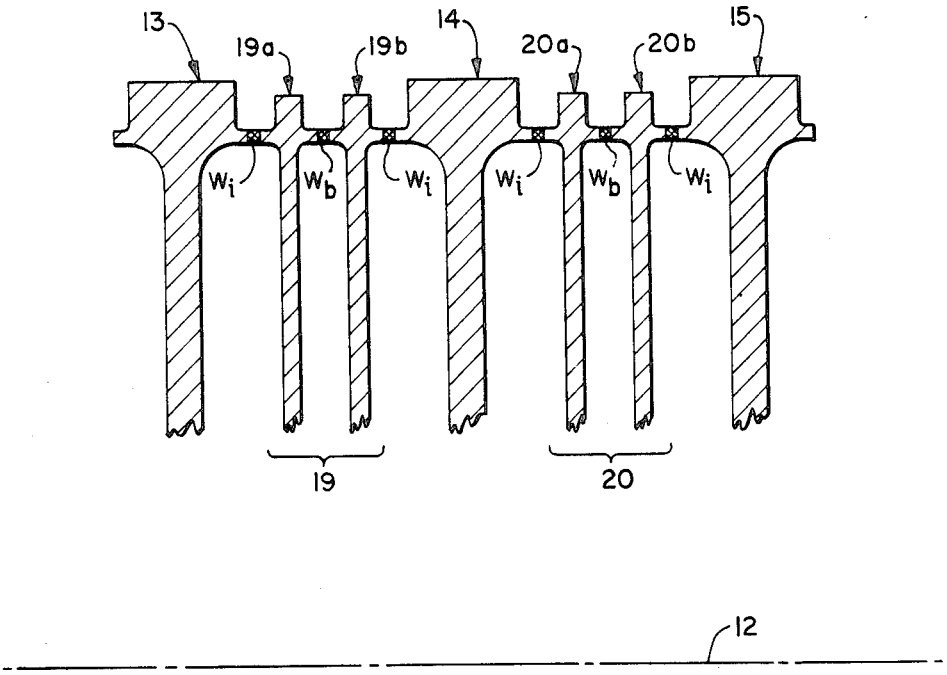

Fabrication of the drum rotor 10 of the invention is shown in FIGS. 2–4. While three disks 13, 14, 15 are shown in the Figures, and the seals 19, 20 each have two knife edges 22, it should be appreciated that the invention is useful in fabricating drum rotors having any number of disks greater than two, and in fabricating drum rotors having greater or less than two knife edges 22 on the seals 19, 20.

FIG. 2 is a simplified, exploded view of FIG. 1, showing the components of the drum rotor 10 before they are joined to each other. FIG. 2 shows one of the important features of the invention, i.e., that the seals 19 and 20 are each comprised of at least two separate annular seal subdetails **19*a*, 19*b* and 20*a*, 20*b*, respectively. As will be made clear below, the subdetails 19*a* and 19*b* are eventually welded together to form seal 19; and the subdetails 20*a* and 20*b* are eventually welded together to form the seal 20**.

The first steps in the fabrication of the drum rotor 10 are to inertia weld or similarly join the seal subdetails to their adjacent disks. As is shown in FIG. 3, the seal subdetail **19*a* is inertia welded to the disk 13; the seal subdetails 19*b* and 20*a* are both inertia welded to the disk 14; and the subdetail 20*b* is inertia welded to the disk 15. The inertia weld joint is denoted $W_i$ in the Figures. Inertia welding techniques such as those disclosed in U.S. Pat. No. 4,033,501 to Ambrose et al may be used. Inertia welding techniques are used to join the IN100 disks to the IN718 seal subdetails because it produces a high quality and relatively crack free weld between these two different composition components. Furthermore, inertia welding produces a desirably small axially extending heat affected zone, which enhances the integrity of the weld joint. The subassemblies which are produced by inertia welding are denoted 21, 23 and 25 in FIG. 3**. Traditional fusion welding processes are not likely useful in joining the disks to their seal subdetails because such processes often produced cracked, and therefore undesirable, weld joints.

The next steps in the fabrication of the drum rotor 10 according to the invention are to circumferentially join the subassemblies 21, 23 and 25 to each other, as shown in FIG. 4, using high energy beam welding techniques. In the Figure, the resulting weld joint is denoted $W_b$. As is seen in this Figure, when the subassemblies 21, 23, 25 are joined to each other, the seals 19, 20 are formed. If the seal subdetails **19*a*, 19*b* and 20*a*, 20*b* are IN718, the use of electron beam (EB) welding to join the subassemblies 21, 23, 25 is preferred. One advantage of the EB process which makes its use particularly desirable in this invention is that the concentricity of the drum rotor 10 can be precisely maintained while the subassemblies 21, 23, 25** are welded together. Furthermore, components made of alloys like IN718 are readily welded to each other using high energy beam techniques such as EB, and the weld joints produced by these techniques are of high quality.

The last step of the fabrication process is to heat treat and machine the drum rotor 10 as required. This includes machining the knife edges 22 into the seals 19, 20 by techniques known to those skilled in the art. It also includes removing any weld flash or similar undesired remnants of the welding processes from the weld joints. All of the components in the pre-weld condition are slightly oversized, to allow for the post-weld machining step. The machined drum rotor 10 is shown in FIG. 1.

Fabrication of a drum rotor 10 according to this invention permits the blade retaining slots 18 to be either axially aligned or circumferentially aligned. Axially aligned slots 18 are preferred, and they are machined into the disk rims 16 prior to welding. The use of axially aligned slots 18 reduces the weight of the individual disks; depending on the size of the disk, weight reductions of up to 15 pounds may be realized, as compared to similarly designed disks which have circumferentially aligned blade retaining slots. Drum rotors made according to prior art methods are limited to having circumferentially aligned blade retaining slots because the disk and knife edge seal are typically made as a one piece rolled or forged component, and the presence of the knife edges precludes the use of broaching tools which are typically used to machine axially aligned slots.

Figure 5:
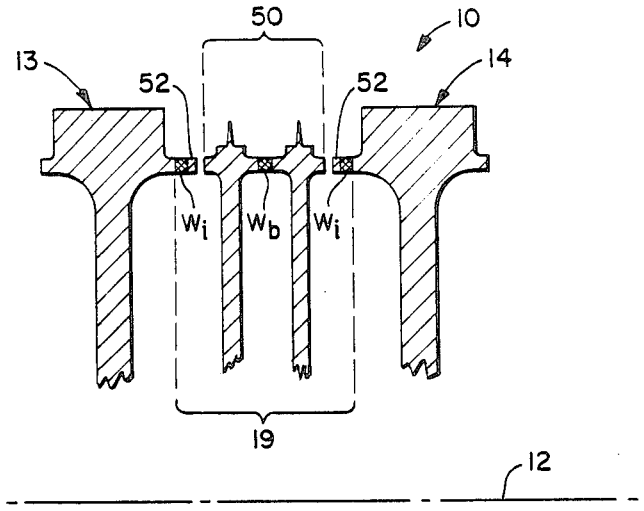
FIGS. 5–6 are simplified section views showing a method for repairing a knife edge seal of the drum rotor according to the invention.
Figure 6:
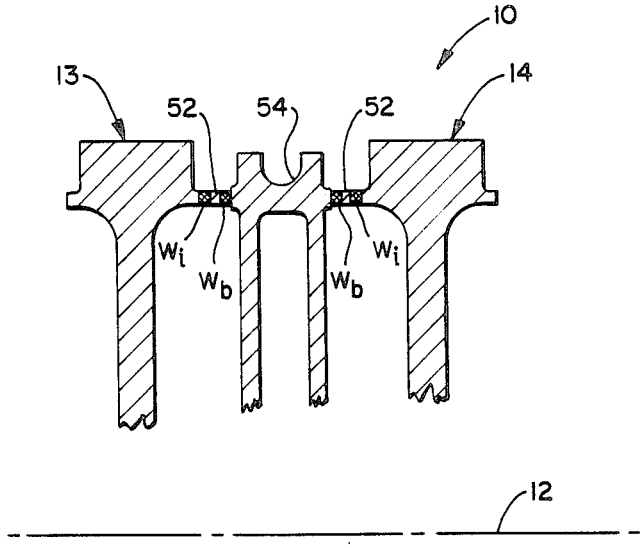

If either of the knife edge seals 19, 20 of the invention drum rotor 10 become damaged during engine operation, or they are otherwise in need of repair, this operation may be performed in the manner shown in FIGS. 5 and 6. These Figures specifically show how the seal 19 is repaired, although the methods are equally applicable to the repair of the seal 20. An annular (360°) portion 50 of the damaged seal 19, which contains the area to be repaired, is removed from the drum rotor 10. As shown in FIG. 5, the damaged portion 50 is removed so that an annular (360°) piece 52 of the seal 19 remains welded to each of its respective, adjacent disks 13, 14. In other words, the damaged portion 50 which is removed is axially between the inertia weld $W_i$ which joins the disk 13 to the seal subdetail **19*a* and the inertia weld $W_i$ which joins the disk 14 to the seal subdetail 19*b*. (See also FIG. 4.) As shown in FIG. 6, a new seal piece 54 is then inserted in place of the damaged portion 50, and is high energy beam welded to the remainder 52 of each of the original seal subdetails. The new seal 54 is of like dimension to the damaged seal 50; the new seal 54 is axially dimensioned so as to maintain the overall axial length of the welded drum rotor 10. There is some amount of excess material provided in the new seal 54 (as shown in FIG. 6) to insure that, e.g., when machined, the knife edges are located in the proper axial and radial position. Electron beam welding is the preferred technique used to join the new seal piece 54 to the existing drum rotor structure, as it allows the overall concentricity of the disks and seals to be maintained. As noted above, the seal alloys are readily welded by such techniques; i.e., high integrity weld joints are produced. A post-welding machining operation is performed to remove any excess material and to machine the knife edges into the seal piece 54**.

The preferred alloys for the manufacture of the drum rotors of the invention are IN100 disks and Inconel 718 seals. Of course, it will be possible to use other combinations of alloys for the disks and seals. Superalloys like Rene 95 will be useful as the disk material. A range of suitable disk superalloy compositions is by weight percent, about 11.5–15.5 Cr, 8–19 Co, 2–4.5 Ti, 3.0–5.5 Al, 2.5–5.5 Mo, 0.01–0.1 C, 0.005–0.025 B, up to 1 V, up to 0.08 Zr, up to 4 Ta, up to 1.6 Cb, up to 0.45 Hf, up to 4 w, with the balance Ni. Alloys which may be used as the seal material besides IN718 include e.g., IN901 or Waspaloy; a range of suitable seal alloy compositions is by weight percent, about 12–22 Cr. 0.5–4 Ti, 0.1–2.0 Al, 2.5–10 Mo, 0.01–0.1 C, 0.005–0.015 B, 2.0–6.0 Cb, up to 15 Co, up to 35 Fe, with the balance Ni.

Although this invention has been shown and described with respect to a preferred embodiment, it will be understood by those skilled in the art that various changes in form and detail thereof may be made without departing from the spirit and scope of that which is claimed.

I claim:

1. A drum rotor for a turbomachine which comprises a first disk, a second disk, and a seal therebetween, the seal comprising a first annular seal subdetail and a second annular seal subdetail, wherein the disks have a superalloy composition different from the seal alloy composition, and wherein an inertia weld joins the alloy of the first disk to the alloy of the first seal subdetail, an inertia weld joins the alloy of the second disk to the alloy of the second seal subdetail, and a high energy beam weld joins the alloy of the first seal subdetail to the alloy of the second seal subdetail.

2. The drum rotor of claim 1, wherein the disks have axially aligned blade retaining slots.

3. The drum rotor of claim 1, wherein the disk superalloy composition is 11.5–15.5 Cr, 8–19 Co, 2–4.5 Ti, 3.0–5.5 Al, 2.5–5.5 Mo, 0.01–0.1 C, 0.005–0.025 B, up to 1 V, up to 0.08 Zr, up to 4 Ta, up to 1.6 Cb, up to 0.45 Hf, up to 4 W, with the balance of Ni, and the seal alloy composition is 12–22 Cr, 0.5–4 Ti, 0.1–2.0 Al, 2.5–10 Mo, 0.01–0.1 C, 0.005–0.015 B, 2–6 Cb, up to 15 Co, up to 35 Fe, with the balance Ni.

4. The rotor of claim 2, wherein the disks are IN100 and the seal subdetails are Inconel Alloy 718.

5. A method for making a drum rotor useful in a gas turbine engine having an axis of rotation, and comprising a first disk, a second disk, and a seal therebetween, the seal comprising a first annular seal subdetail and a second annular seal subdetail, wherein the disks have a superalloy composition different from the seal subdetail alloy composition, the method comprising the steps of:

(a) inertia welding the first disk to the first seal subdetail to form a first annular subassembly;

(b) inertia welding the second disk to the second seal subdetail to form a second annular subassembly; and then (c) high energy beam welding the first subassembly to the second subassembly to form the drum rotor.

6. The method of claim 5, further comprising the step of machining the seal to a knife edge configuration.

7. The method of claim 5, further comprising the step of machining axially aligned blade retaining slots in each disk before said steps of inertia welding.

8. The method of claim 5, wherein the disk superalloy composition is 11.5–15.5 Cr, 8–19 Co, 2–4.5 Ti, 3.0–5.5 Al, 2.5–5.5 Mo, 0.01–0.1 C, 0.005–0.025 B, up to 1 V, up to 0.08 Zr, up to 4 Ta, up to 1.6 Cb, up to 0.45 Hf, up to 4 W, with the balance Ni, and the seal alloy composition is 12–22 Cr, 0.5–4.0 Ti, 0.1–2.0 Al, 2.5–10 Mo, 0.01–0.1 C, 0.005–0.15 B, 2–6 Cb, up to 15 Co, up to 35 Fe, with the balance Ni.

9. The method of claim 5, wherein the disk superalloy composition is IN100 and the seal alloy composition is Inconel Alloy 718.

10. A method for repairing a damaged or worn area of the seal in the drum rotor made according to claim 5, comprising the steps of:

(a) removing an annular portion of the seal from the drum rotor, said portion being axially between the inertia weld which joins the first disk to the first seal subdetail and the inertia weld which joins the second disk to the second seal subdetail, said portion containing the damaged or worn area of the seal;

(b) replacing said removed portion with an undamaged seal detail of like axial and radial dimension; and (c) high energy beam welding said undamaged seal detail to the first and second seal subdetails.

11. A one piece drum rotor for use in a gas turbine engine, comprising at least two disks and a seal therebetween, wherein the disks have a superalloy composition and the seal has an alloy composition different from said superalloy composition, and wherein the disks have axially aligned blade retaining slots.

12. A gas turbine engine drum rotor having an axis of rotation, said drum rotor comprising:

a first disk;

a second disk axially downstream of said first disk; and a seal axially between and welded to said first and second disks;

wherein said disks have a disk alloy composition and said seal has a seal alloy composition different from said disk alloy composition; and wherein each disk has an axially forward facing surface and an axially rearward facing surface, said surfaces having said disk alloy composition;

said seal comprises a first annular seal subdetail and a second annular seal subdetail, each subdetail having an axially forward facing surface and an axially rearward facing surface, said surfaces having said seal alloy composition;

wherein an inertia weld joins the axially rearward facing surface of said first disk to the axially forward facing surface of the first seal subdetail; an inertia weld joins the axially forward facing surface of said second disk to the axially rearward facing surface of the second seal subdetail; and a high energy beam weld joins the axially rearward facing surface of the first seal subdetail to the axially forward facing surface of the second seal subdetail.

* * * * *